US009140113B2

(12) United States Patent
Hurst et al.

(10) Patent No.: US 9,140,113 B2
(45) Date of Patent: Sep. 22, 2015

(54) INSTRUMENTED ROD ROTATOR

(75) Inventors: Gregg W. Hurst, Humble, TX (US); Jeffrey J. Lembcke, Cypress, TX (US); Bryan A. Paulet, Spring, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 438 days.

(21) Appl. No.: 13/585,048

(22) Filed: Aug. 14, 2012

(65) Prior Publication Data

US 2013/0181844 A1 Jul. 18, 2013

Related U.S. Application Data

(60) Provisional application No. 61/585,895, filed on Jan. 12, 2012.

(51) Int. Cl.

| | |
|---|---|
| ***G01V 3/00*** | (2006.01) |
| ***E21B 47/00*** | (2012.01) |
| ***E21B 43/12*** | (2006.01) |

(52) U.S. Cl.

CPC ..... *E21B 47/0008* (2013.01); *E21B 43/127* (2013.01)

(58) Field of Classification Search

USPC ..... 340/853.2, 854.4, 854.5, 854.8, 856.3, 340/856.4, 855.2; 166/75.14, 78.1, 105, 166/250.01, 250.15, 252.5, 253.1, 254.2, 166/381, 386, 387, 369

See application file for complete search history.

(56) References Cited

U.S. PATENT DOCUMENTS

| | | | | |
|---|---|---|---|---|
| 3,722,608 | A * | 3/1973 | Faulk | 175/65 |
| 3,928,841 | A * | 12/1975 | Vogel | 340/854.5 |
| 4,655,300 | A * | 4/1987 | Davis et al. | 175/39 |
| 4,683,542 | A * | 7/1987 | Taniguti | 702/56 |
| 4,747,451 | A * | 5/1988 | Adams et al. | 340/854.4 |
| 4,884,071 | A * | 11/1989 | Howard | 340/854.8 |
| RE33,690 | E * | 9/1991 | Adams et al. | 340/854.4 |
| 5,427,178 | A * | 6/1995 | Bland | 166/78.1 |
| 6,085,599 | A * | 7/2000 | Feller | 73/861.13 |
| 6,241,028 | B1 * | 6/2001 | Bijleveld et al. | 175/40 |
| 7,392,713 | B2 * | 7/2008 | Barkhoudarian | 73/862.331 |
| 7,448,444 | B2 * | 11/2008 | Thomson et al. | 166/75.14 |
| 7,857,043 | B2 * | 12/2010 | Ali-zada et al. | 166/78.1 |
| 8,245,794 | B2 * | 8/2012 | Morris | 175/45 |
| 2003/0169167 | A1 * | 9/2003 | Fey et al. | 340/540 |
| 2004/0060371 | A1 * | 4/2004 | Barkhoudarian | 73/862.331 |
| 2004/0256101 | A1 * | 12/2004 | Fox et al. | 166/252.5 |
| 2004/0256113 | A1 * | 12/2004 | LoGiudice et al. | 166/381 |
| 2006/0000605 | A1 | 1/2006 | Jordan et al. | |
| 2007/0235199 | A1 * | 10/2007 | LoGiudice et al. | 166/386 |
| 2008/0037368 | A1 * | 2/2008 | Newman | 367/69 |
| 2008/0291048 | A1 * | 11/2008 | Huiszoon et al. | 340/856.3 |
| 2009/0120637 | A1 * | 5/2009 | Kirkwood et al. | 166/254.2 |
| 2009/0151939 | A1 * | 6/2009 | Bailey et al. | 166/255.1 |
| 2010/0044034 | A1 * | 2/2010 | Bailey et al. | 166/253.1 |

(Continued)

OTHER PUBLICATIONS

Office Action dated Apr. 11, 2014, issued by the Canadian Intellectual Property Office in Application No. 2,800,593.

(Continued)

*Primary Examiner* — Paul Obiniyi

(74) *Attorney, Agent, or Firm* — Patterson & Sheridan, LLP

(57) ABSTRACT

Methods and apparatus are provided for monitoring the rotation of a member in a reciprocating rod lift system. In this manner, rod and tubing wear of the system may be minimized.

18 Claims, 8 Drawing Sheets

(56) References Cited

U.S. PATENT DOCUMENTS

| | | | | |
|---|---|---|---|---|
| 2010/0158082 | A1* | 6/2010 | Galinski | 375/216 |
| 2010/0186944 | A1* | 7/2010 | Hall et al. | 166/65.1 |
| 2011/0186290 | A1* | 8/2011 | Roddy et al. | 166/253.1 |
| 2011/0187556 | A1* | 8/2011 | Roddy et al. | 340/853.3 |
| 2011/0192592 | A1* | 8/2011 | Roddy et al. | 166/250.01 |
| 2011/0192593 | A1* | 8/2011 | Roddy et al. | 166/250.01 |
| 2011/0192594 | A1* | 8/2011 | Roddy et al. | 166/250.01 |
| 2011/0192597 | A1* | 8/2011 | Roddy et al. | 166/253.1 |
| 2011/0192598 | A1* | 8/2011 | Roddy et al. | 166/253.1 |
| 2011/0199228 | A1* | 8/2011 | Roddy et al. | 340/856.4 |
| 2012/0085552 | A1 | 4/2012 | Travis et al. | |
| 2013/0014941 | A1* | 1/2013 | Tips et al. | 166/250.15 |
| 2013/0014959 | A1* | 1/2013 | Tips et al. | 166/387 |

OTHER PUBLICATIONS

Smith, Dean, "Rod Rotator Torque in Rod Strings," R&M Energy Services, Oct. 18, 2000.

* cited by examiner

INSTRUMENTED ROD ROTATOR

CROSS-REFERENCE TO RELATED APPLICATIONS

This application claims benefit of U.S. Provisional Patent Application Ser. No. 61/585,895, filed Jan. 12, 2012, which is herein incorporated by reference.

BACKGROUND OF THE INVENTION

1. Field of the Invention

Embodiments of the present invention generally relate to monitoring the rotation of a member in a reciprocating rod lift system.

2. Description of the Related Art

The production of oil with a sucker-rod pump is common practice in the oil and gas industry. An oil well generally comprises a casing, a string of smaller steel pipe inside the casing and generally known as the tubing, a pump at the bottom of the well, and a string of steel rods, commonly referred to as sucker rods, within the tubing and extending down into the pump for operating the pump. Various devices as are well known in the art are provided at the top of the well for reciprocating the sucker rod to operate the pump.

The crude oil generally contains paraffin and other substances which tend to congeal and precipitate out of the oil and deposit upon the walls of the tubing during the passage of the oil through the tubing. Such deposits are quite objectionable and tend to restrict the flow of oil through the tubing. Moreover, operating the pump with an excessive amount of the deposits may lead to severe rod and tubing wear. Various means and methods have been proposed for preventing the formation of such deposits and for removing deposits so formed. Such means and methods generally include the use of chemicals, electrical heating and various mechanical scraping devices. In general, such means and methods may be expensive and have other objectionable features.

A common mode of preventing the formation of deposits on the tubing and removing such deposits as they are formed generally include attaching paraffin scrapers to the sucker rod. Such sucker rods may remove the deposits from the oil well tubing as it is formed so that it is flushed out of the well with the oil passing therethrough. In many cases, the means for reciprocating the sucker rods include devices, such as a rod rotator, for rotating the rods through a predetermined angle during each stroke of the sucker rods. The rod rotator may be installed on the wellhead and connected to a walking beam. With each stroke of the pumping unit, the rotator may rotate the rods a fraction of one revolution. As the rods are rotated, paraffin may be scraped off the walls of the tubing in an effort to distribute wear.

SUMMARY OF THE INVENTION

One embodiment of the present invention is a method. The method generally includes monitoring rotation of a member in a reciprocating rod lift system, wherein the member is to be rotated to distribute wear, and generating a signal indicative of the monitored rotation.

Another embodiment of the present invention provides an apparatus. The apparatus generally includes a mechanism in a reciprocating rod lift system, wherein the mechanism is configured to monitor rotation of a member in the system, wherein the member is to be rotated to distribute wear, and generate a signal indicative of the monitored rotation.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
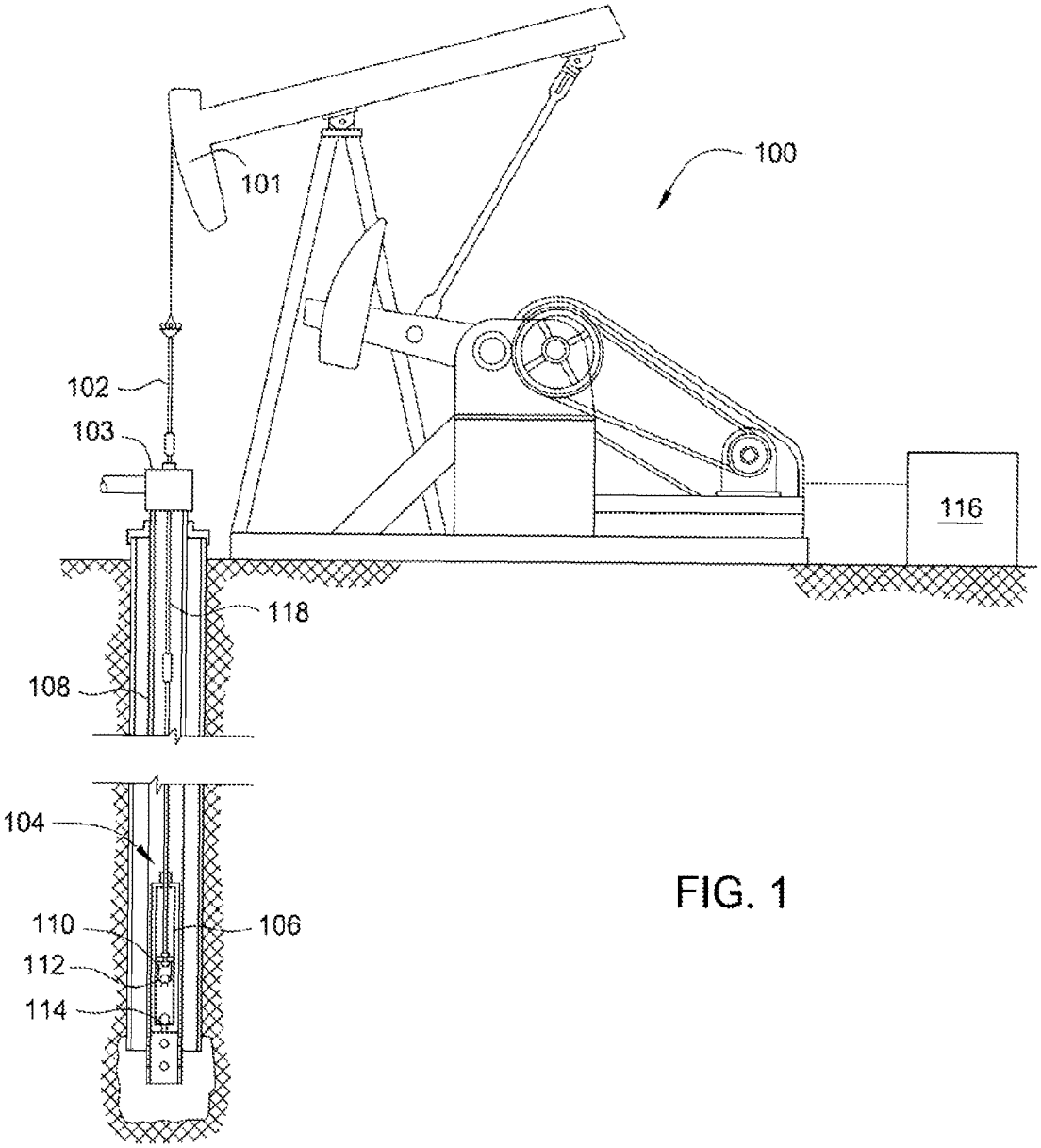
FIG. 1 is a schematic depiction of an illustrative sucker-rod pumping unit with a control unit for controlling the pump in an effort to extract fluid from a well.

The production of oil with a reciprocating rod lift system 100 (e.g., sucker-rod pump system), such as that depicted in FIG. 1, is common practice in the oil and gas industry. Although shown with a conventional pumping unit, any suitable pumping unit may be used. In the pump system 100, a rod pump 104 consists of a tubular barrel 106 with a valve 114 (the "standing valve") located at the bottom that allows fluid to enter from the wellbore, but does not allow the fluid to leave. Inside the pump barrel 106 is a close-fitting hollow plunger 110 with another valve 112 (the "traveling valve") located at the top. This allows fluid to move from below the plunger 110 to the production tubing 108 above and does not allow fluid to return from the tubing 108 to the pump barrel 106 below the plunger 110. The plunger 110 may be moved up and down cyclically by a horsehead 101 at the surface via the rod string 102 (e.g., a string of steel rods or a continuous rod string), wherein the motion of the pump plunger 110 comprises an "upstroke" and a "downstroke," jointly referred to as a "stroke." The polished rod 118, which is a portion of the rod string 102 passing through a stuffing box 103, may enable an efficient hydraulic seal to be made around the reciprocating rod string 102. A control unit 116, which may be located at the surface, may control the system 100.

As mentioned above, the crude oil generally contains paraffin and other substances which tend to congeal and precipitate out of the oil and deposit upon the walls of the tubing 108 during the passage of the oil through the tubing 108. As a result, as the rod string 102 is moved up and down cyclically, the rod string 102 may cause excessive and uneven wear inside the tubing 108, and cause wear on the rod string 102. For some embodiments, the means for reciprocating the sucker rods may include devices, such as a rod rotator or a tubular rotator, for rotating members, such as the rod string 102 or the tubing 108, respectively, through a predetermined angle during each stroke of the rod string 102. By rotating the rod string 102 or the tubing 108 while the reciprocating rod lift system 100 is operating, the inside surface of the tubing 108 may be worn evenly, which may extend the life of the tubing 108 and the rod string 102. The rotator may be installed on the wellhead and connected to a walking beam, as illustrated in FIG. 2.

Figure 2:
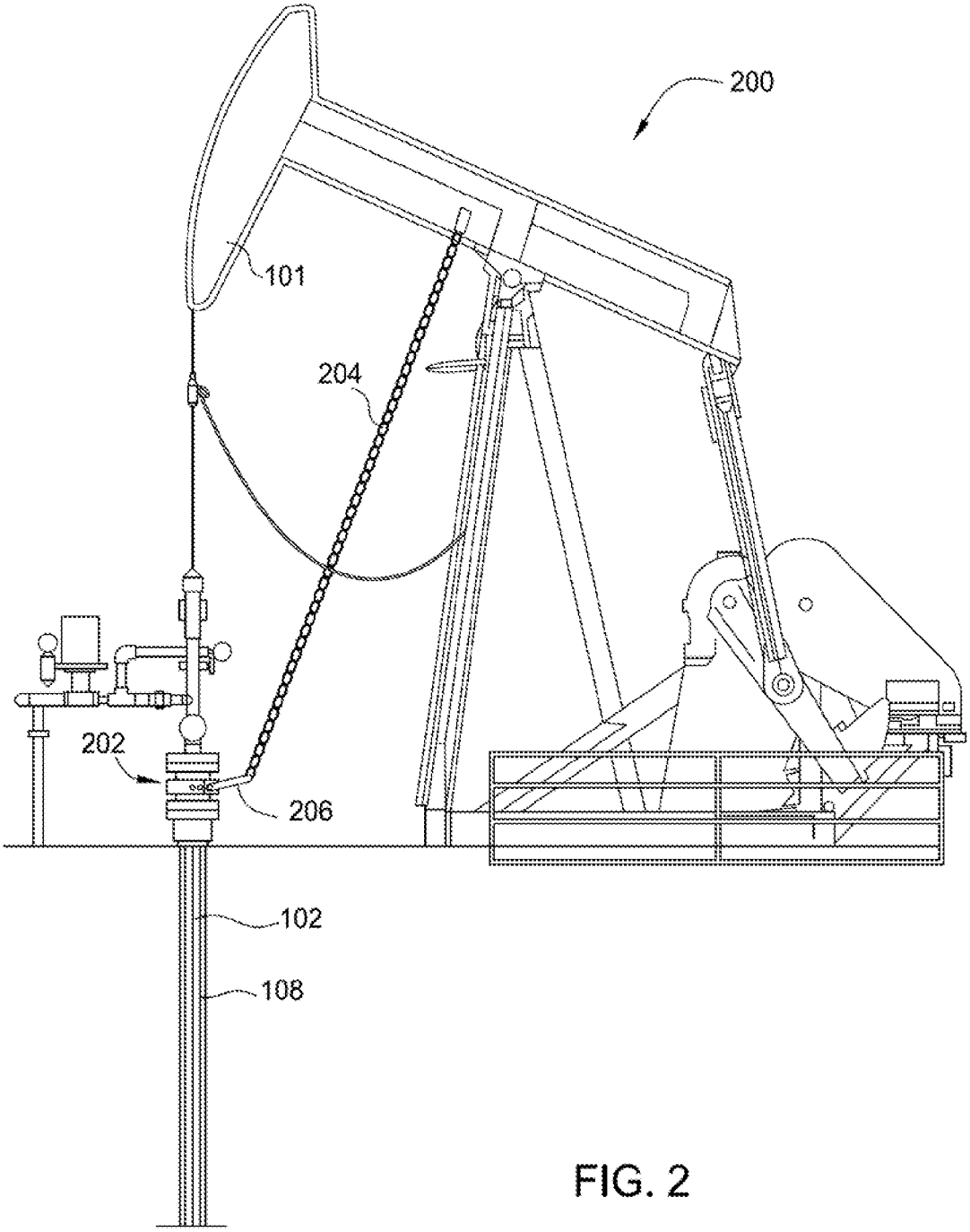
FIG. 2 illustrates a reciprocating rod lift system with a rotator for rotating a member of the system, according to embodiments of the present invention.

FIG. 2 illustrates a reciprocating rod lift system 200 with a rotator 202 for rotating a member of the system 200, according to embodiments of the present invention. The rotator 202 may be installed above the wellhead. As the horsehead 101 operates, an interconnecting chain 204 may pull a lever 206 of a ratchet or similar mechanism coupled to the rotator 202. With the cyclical motion of the horsehead 101, the rotator 202 may then rotate a member, such as the rod string 102 or the tubing 108 by at least a fraction of one revolution (e.g., several degrees). In this way, wear inside the tubing 108 caused by the rod string 102 may be more evenly distributed around an internal circumference of the tubing 108. Although FIG. 2 illustrates activation of the rotator 202 by way of the horsehead 101, the rotator 202 may be activated by other means, such as, but not limited to, a flexible drive cable, an electronically controlled drive, or hydraulic pressure.

Figure 3:
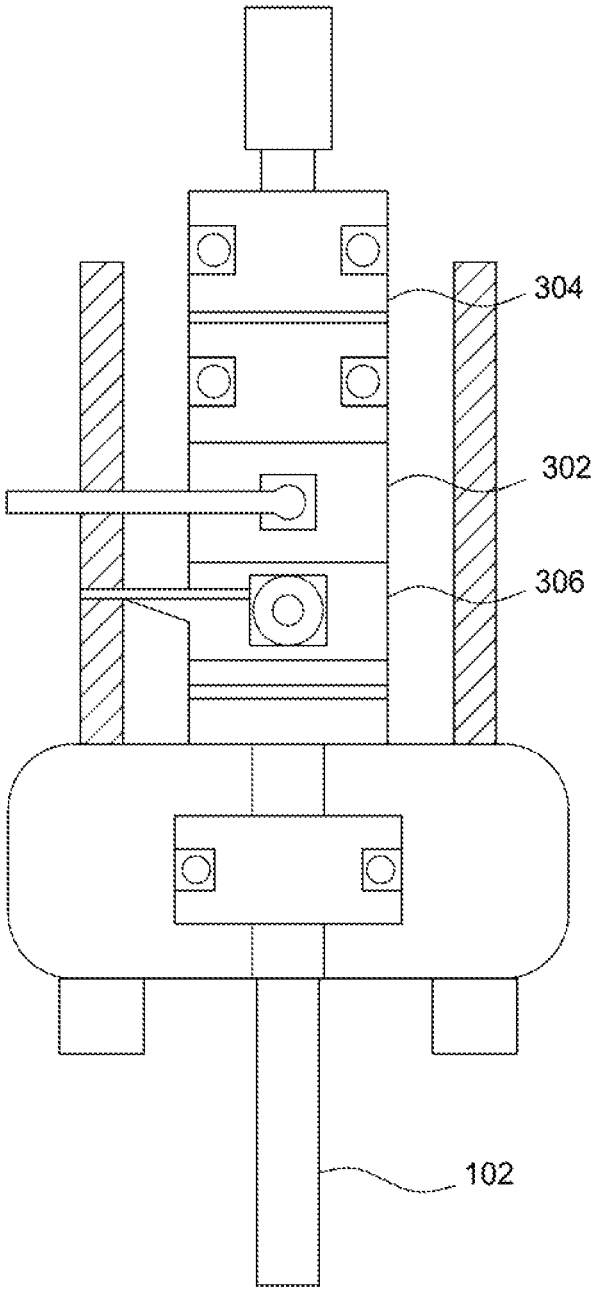
FIG. 3 illustrates a rod rotator installed in a reciprocating rod lift system, according to embodiments of the present invention.

FIG. 3 illustrates a rod rotator 302 installed in a reciprocating rod lift system, according to embodiments of the present invention. The rod rotator 302 may be disposed below a rod clamp 304 that is clamped around a rod string 102. As the rod rotator 302 rotates, the weight of the rod clamp 304 on the rod rotator 302 causes the rod clamp 304 (and rod string 102) to rotate also. The rod rotator 302 may be disposed above a load cell 306 that detects the tensional or compressional forces being imparted to the rod string 102 at surface.

In certain situations, a rotator may not function as desired. For example, the rod string or the rotator may not always rotate with each stroke of the pumping unit. Referring back to FIG. 2, there may be issues with the connection between the rotator 202 and the walking beam (e.g., due to interconnecting chain 204) that may not actuate the lever 206 of the rotator 202. A lack of knowledge whether the rotator 202 is functioning properly may lead to increased expenditures and a decrease in well production.

Certain embodiments of the present invention provide methods and apparatus for monitoring rotation of a rod string in a reciprocating rod lift system. In addition to monitoring the rod string, any member in the reciprocating rod lift system may be monitored for rotation. Examples of other members include the tubing that surrounds the rod string (e.g., by a tubular rotator), or any other member attached to one of these that rotates at the same time.

Figure 4:
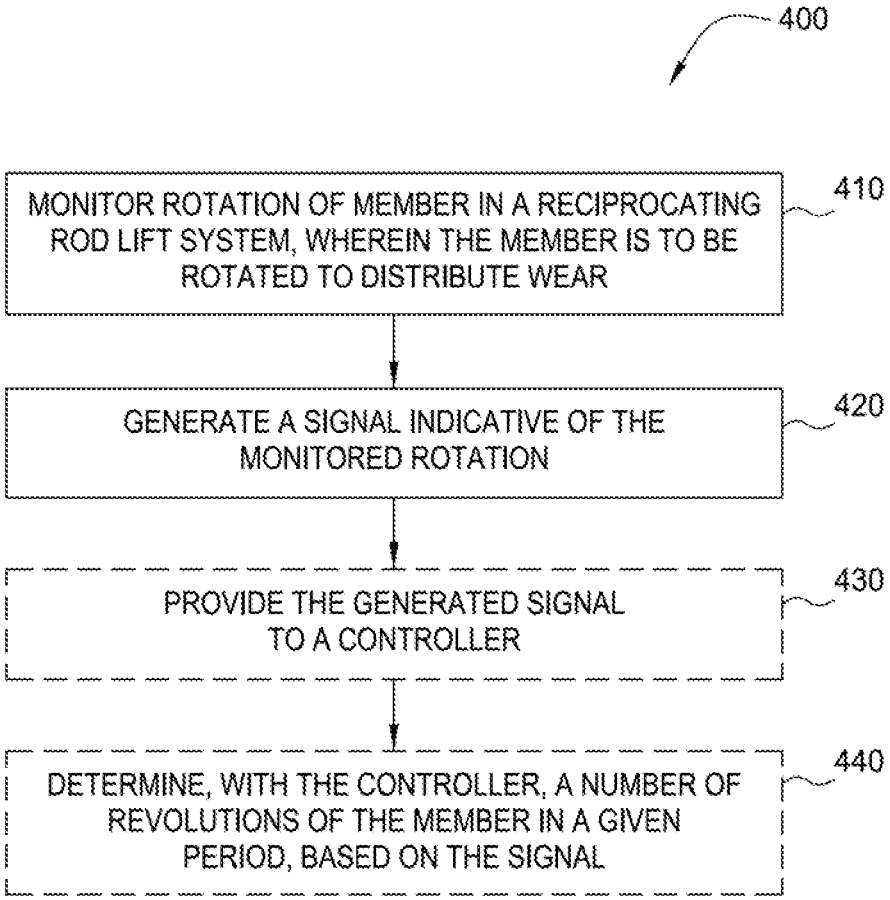
FIG. 4 illustrates operations for monitoring the rotation of a member in a reciprocating rod lift system, according to embodiments of the present invention.

FIG. 4 illustrates operations 400 for monitoring the rotation of a member in a reciprocating rod lift system, according to embodiments of the present invention. The operations may begin at 410 by monitoring the rotation of the member (e.g., rod string 102 or tubing 108) in the reciprocating rod lift system, wherein the member is rotated to distribute wear, as described above. Examples of the member generally include a sucker rod string, a continuous rod string, tubing that surrounds the sucker rod string or the continuous rod string, or any other member attached to one of these that rotates at the same time. As an example, the monitoring may be performed by a mechanism incorporated in at least one of a load cell, a rod rotator, or a tubing rotator. At 420, a signal indicative of the monitored rotation may be generated.

For some embodiments, monitoring may include detecting one or more magnets. For some embodiments, the magnets may be installed in one or more locations around the member. For some embodiments, the magnets may be installed in one or more locations within the mechanism. The signal indicative of the monitored rotation may be generated by a switch when the magnets pass a fixed location. Examples of the switch generally include at least one of a Hall Effect sensor, a reed switch, or a position/proximity sensor. With one magnet, the signal generated by the switch may indicate a complete revolution of the member. However, with multiple magnets, signals generated by the switch may indicate partial revolutions of the member.

For some embodiments, monitoring may include detecting one or more radio-frequency identification (RFID) tags. Use of RFID tags may be desirable due to its light weight & low power requirements. The signal indicative of the monitored rotation may be generated by a receiver when the RFID tags pass a fixed location. As an example, if an RFID tag is affixed to a rod rotator, the receiver may monitor every time the RFID tag passes the fixed location. Therefore, it may be known how often the member makes a complete revolution.

With regards to a load cell, a mechanism incorporated in the load cell may generally include a Hall Effect sensor, a reed switch, or other sensor, as described above. It may be possible to monitor the rotation of a rod string disposed within the load cell. For some embodiments, the rod string may have one or more magnetic strips or RFID tags disposed along a length of rod string, wherein a signal indicative of the monitored rotation may be generated by the sensor when the magnetic strips or RFID tags pass a fixed location.

Figure 5A:
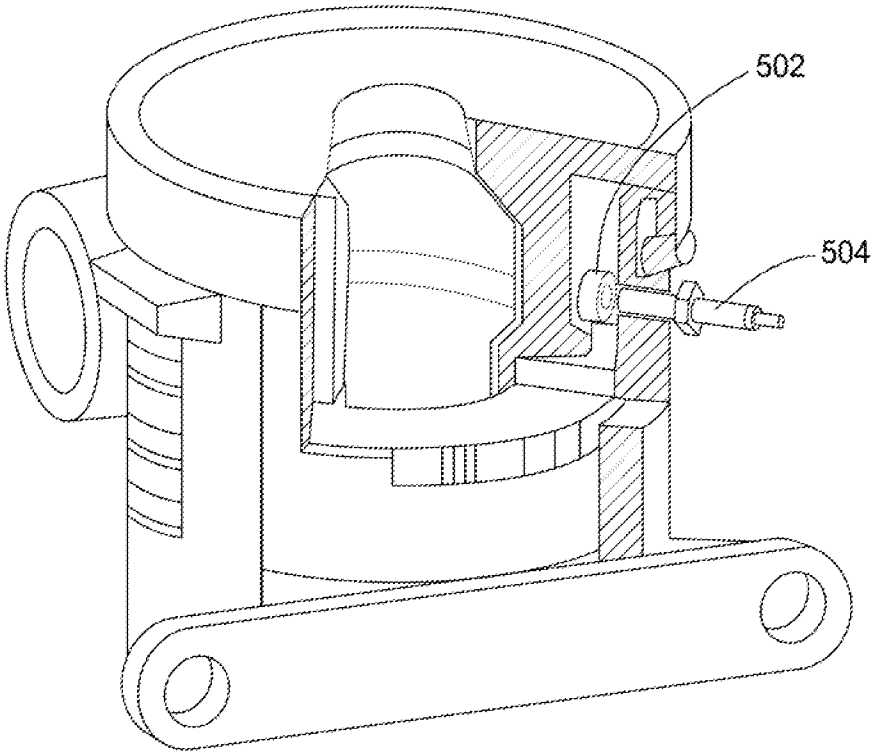
FIGS. 5A-B illustrate the inner rotating assembly of rotators, according to embodiments of the present invention.

With regards to a rotator, such as a rod rotator or a tubular rotator, the member that is monitored for rotation may include an inner rotating assembly of the rotator itself. FIG. 5A illustrates the inner rotating assembly of a rod rotator, according to embodiments of the present invention. The inner rotating assembly may include one or more magnets 502 (or other devices, such as RFID tags) installed in one or more locations, and the outer housing of the rod rotator may include a switch 504 (e.g., Hall Effect sensor, reed switch, or position/proximity sensor) for generating the signal indicative of the monitored rotation when the magnets pass a fixed location.

Figure 5B:
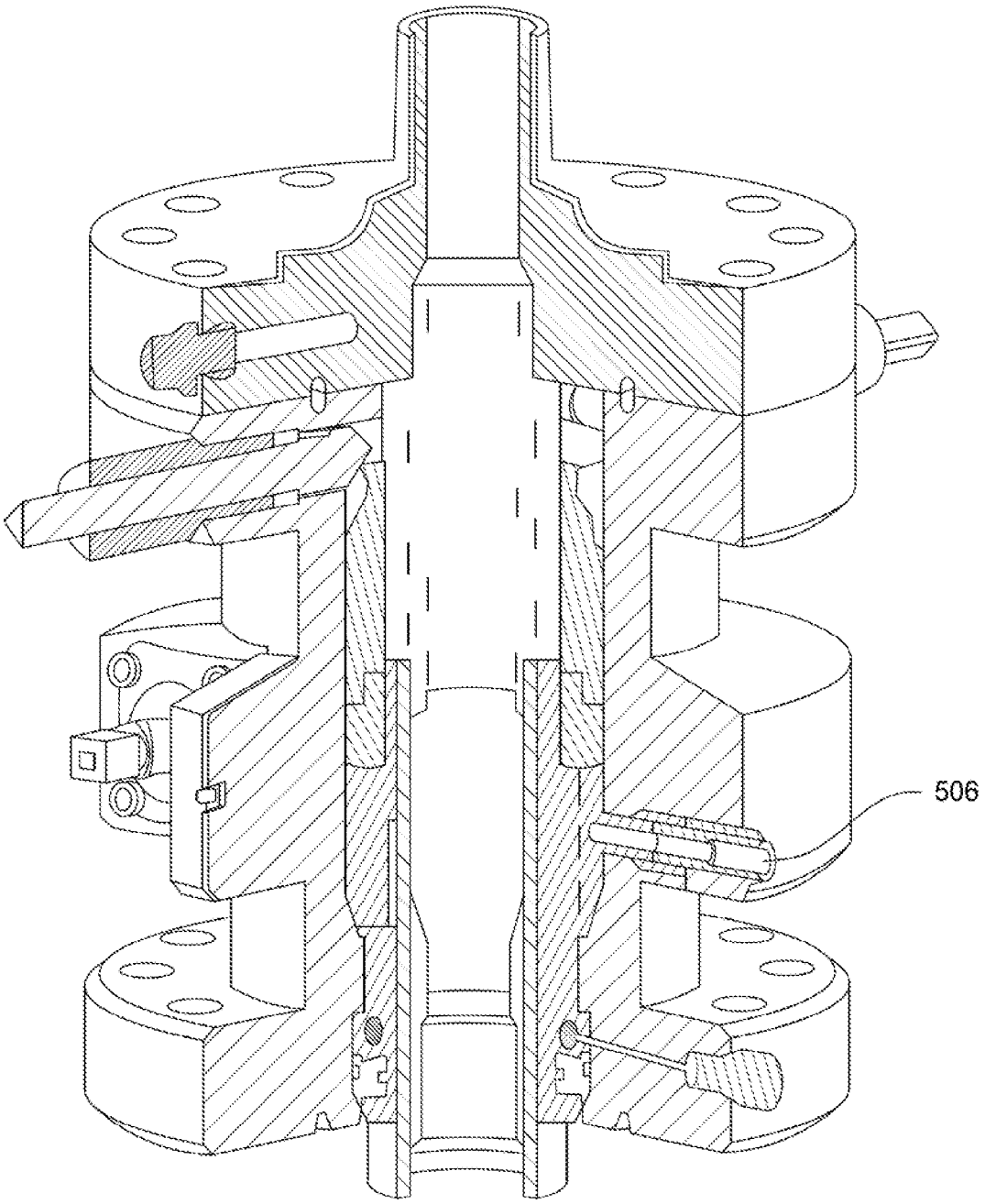

FIG. 5B illustrates the inner rotating assembly of a tubular rotator, according to embodiments of the present invention. The tubular rotator may include one or more magnets and a switch, similar to the arrangement illustrated in FIG. 5A for a rod rotator, for example, within a sensor assembly housing 506 of the tubular rotator. However, since tubular rotators are normally disposed below the wellhead and, as a result, exposed to downhole conditions, any electronics involved with monitoring the rotation may have to be isolated.

Figure 6:
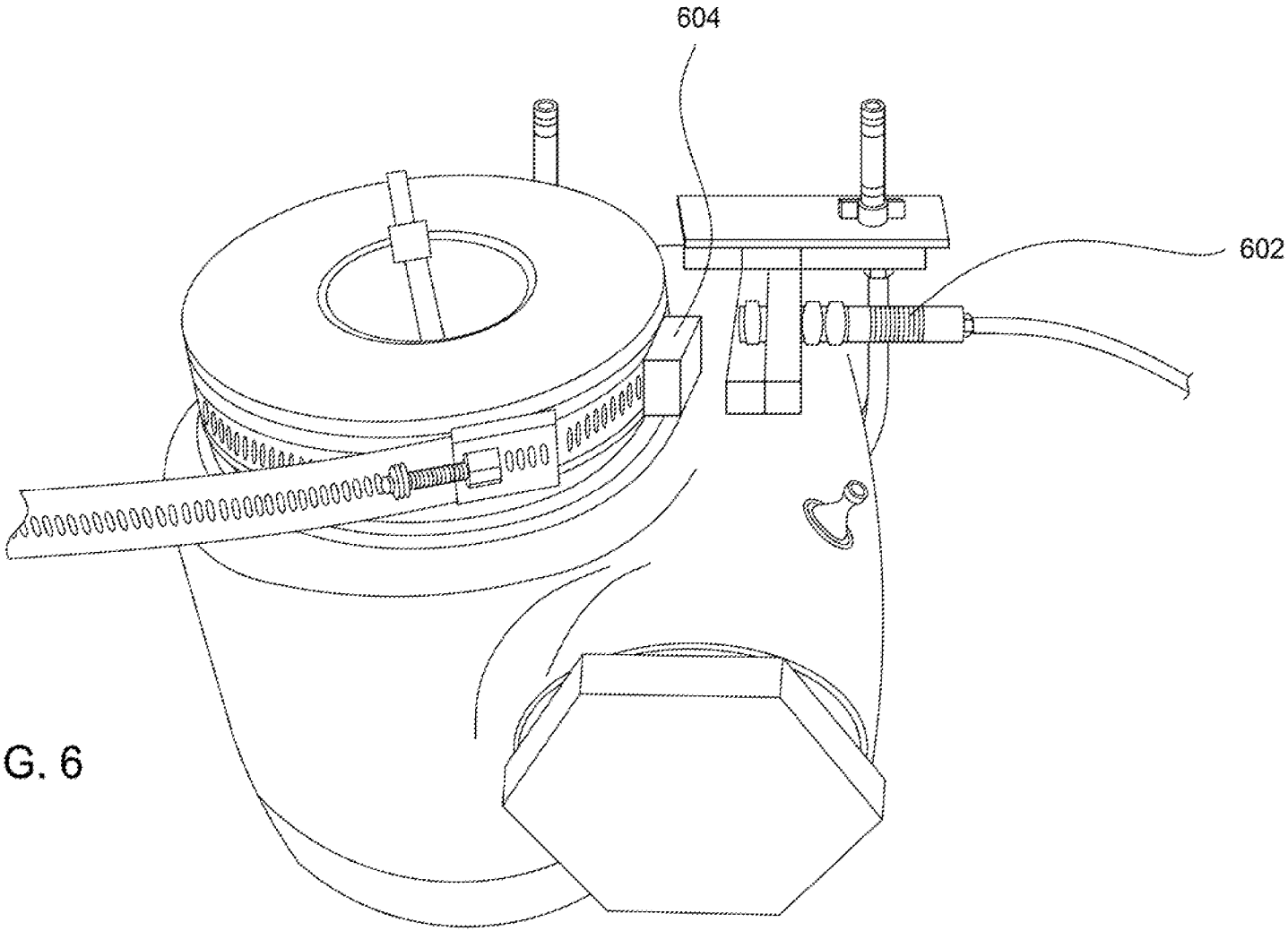
FIG. 6 illustrates an upgrade kit for a rod rotator, according to embodiments of the present invention.

FIG. 6 illustrates an upgrade kit for a rod rotator, according to embodiments of the present invention. Certain rod rotators installed at a well site may not have the capability to monitor the rotation of a member in a reciprocating rod lift system. Therefore, for some embodiments, such rod rotators may be upgraded to monitor for rotation, as illustrated in FIG. 6. The upgrade kit generally includes a rotation sensor 602 (e.g., Hall Effect sensor, reed switch, or position/proximity sensor) and one or more magnets 604 (or other devices, such as RFID tags). The magnets 604 may be strapped around a portion of the rotator that rotates on each stroke of the pumping unit, and the sensor 602 may be set at a fixed location. The signal indicative of the monitored rotation may be generated by the sensor 602 when the magnets 604 pass the fixed location. With one magnet 604, the signal generated by the sensor 602 may indicate a complete revolution of the member. However, with multiple magnets 604, signals generated by the sensor 602 may indicate partial revolutions of the member.

Referring back to FIG. 4, at 430, the generated signal may be provided to a controller (e.g., rod pump controller). At 440, the controller may determine a number of revolutions (cycle counts) of the member in a given period based on the signal. For some embodiments, the controller may generate an alarm if the signal indicates no change in value (or less than expected) in the number of revolutions of the member within a threshold interval (e.g., hourly or daily). Furthermore, the controller may communicate information (e.g., related to the alarm) to a software system located at a central location, where information related to different wells may be monitored. For example, the information may be reported back to a host system through an existing radio infrastructure. For some embodiments, an application may be developed in the firmware of the controller to determine if a rotator is operational and generate an alarm based on operator set limits.

Figure 7:
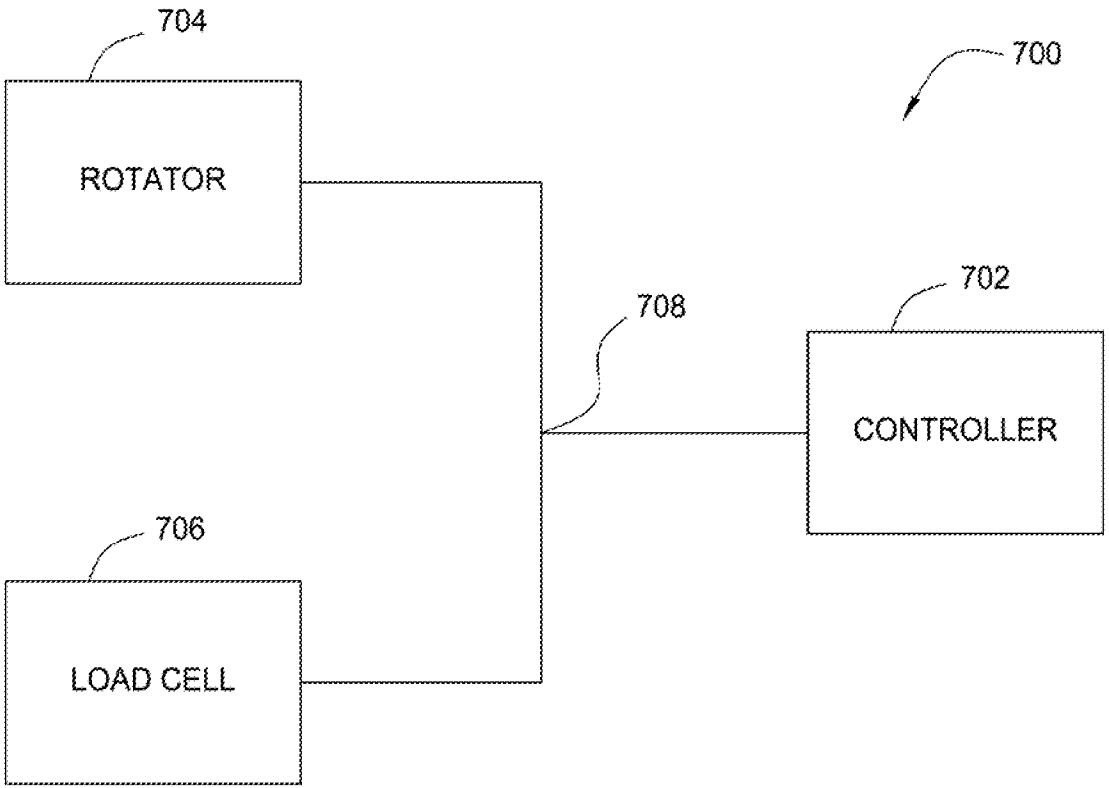
FIG. 7 illustrates a cable connector design for monitoring the rotation of a member in a reciprocating rod lift system, according to embodiments of the present invention.

FIG. 7 illustrates a cable connector design 700 for monitoring the rotation of a member in a reciprocating rod lift system, according to embodiments of the present invention. Traditionally, a load cell is connected directly to a controller for detecting the tensional or compressional forces being imparted to a rod string at surface. However, when the mechanism for monitoring rotation is located in a rotator (e.g., rotator 704), the rotator 704 and a load cell 706 may share a connection with a controller 702 (e.g., via a Y-connector).

With the ability to monitor the rotation of a member in a reciprocating rod lift system, rod and tubing wear of the system may be minimized. For example, if there is a determination that the member is not properly rotating, efforts may be made to correct the issue, in order to avoid, for example, paraffin buildup. There may also be an improvement in the utilization of maintenance personnel, a reduction in the causes of lost production, and an increase in well surveillance capabilities. With the increase in well run life, reduction of well down time, production may increase accordingly.

While the foregoing is directed to embodiments of the present invention, other and further embodiments of the invention may be devised without departing from the basic scope thereof, and the scope thereof is determined by the claims that follow.

What is claimed is:

1. A method for monitoring a reciprocating rod lift system, comprising:
- monitoring rotation of a member in the reciprocating rod lift system;
- generating a signal indicative of the monitored rotation;
- determining a number of revolutions of the member in a given period, based on the signal; and
- generating an alarm if the number of revolutions of the member is different than an expected value, wherein the expected value is based on strokes of a pumping unit in the reciprocating rod lift system and on a rotational angle associated with each of the strokes.

2. The method of claim 1, wherein the monitoring is performed by a mechanism incorporated in at least one of a load cell, a rod rotator, or a tubing rotator.

3. The method of claim 1, wherein the monitoring comprises detecting one or more magnets.

4. The method of claim 3, wherein the magnets are installed in one or more locations around the member.

5. The method of claim 3, wherein the generating the signal comprises generating the signal by a switch when the magnets pass a fixed location.

6. The method of claim 1, wherein the monitoring comprises detecting one or more radio-frequency identification (RFID) tags.

7. The method of claim 6, wherein the RFID tags are installed in one or more locations around the member.

8. The method of claim 1, further comprising:
- communicating information related to the alarm to a central location.

9. An apparatus for monitoring a reciprocating rod lift system, comprising:
- a mechanism configured to:
  - monitor rotation of a member in the reciprocating rod lift system; and
  - generate a signal indicative of the monitored rotation; and
- a controller configured to:
  - determine a number of revolutions of the member in a given period, based on the signal; and
  - generate an alarm if the number of revolutions of the member is different than an expected value, wherein the expected value is based on strokes of a pumping unit in the reciprocating rod lift system and on a rotational angle associated with each of the strokes.

10. The apparatus of claim 9, wherein the mechanism is incorporated in at least one of a load cell, a rod rotator, or a tubing rotator.

11. The apparatus of claim 9, wherein the mechanism is configured to monitor the rotation of the member by detecting one or more magnets.

12. The apparatus of claim 11, wherein the magnets are installed in one or more locations around the member.

13. The apparatus of claim 11, wherein the magnets are installed in one or more locations within the mechanism.

14. The apparatus of claim 11, wherein the mechanism comprises a switch configured to generate the signal when the magnets pass a fixed location.

15. The apparatus of claim 14, wherein the switch comprises at least one of a Hall effect sensor or a reed switch.

16. The apparatus of claim 9, wherein the mechanism is configured to monitor the rotation of the member by detecting one or more radio-frequency identification (RFIO) tags.

17. The apparatus of claim 9, wherein the controller is further configured to:
- communicate information related to the alarm to a central location.

18. The apparatus of claim 9, wherein the member comprises at least one of a sucker rod string, a continuous rod string, tubing that surrounds the sucker rod string or the continuous rod string, or any other member attached to one of these that rotates at the same time.

* * * * *